United States Patent [19]

Jenne

[11] 4,101,861

[45] Jul. 18, 1978

[54] THERMOSTATIC SWITCH AND METHOD OF ASSEMBLY

[75] Inventor: Richard L. Jenne, Attleboro, Mass.

[73] Assignee: Texas Instruments Incorporated, Dallas, Tex.

[21] Appl. No.: 666,850

[22] Filed: Mar. 15, 1976

[51] Int. Cl.[2] ..... H01H 37/12; H01H 37/54

[52] U.S. Cl. ..... 337/368; 29/593; 29/622; 337/380

[58] Field of Search ..... 337/319, 360, 365, 347, 337/368, 372, 380, 57; 73/378.3; 29/593, 622; 200/246, 283, 249

[56] References Cited

U.S. PATENT DOCUMENTS

| | | | |
|---|---|---|---|
| Re. 28,019 | 5/1974 | Schmitt | 337/347 |
| 1,766,965 | 6/1930 | Thomas | 73/378.3 |
| 2,591,684 | 4/1952 | Deakin | 200/246 |
| 2,753,421 | 7/1956 | Mertler | 337/347 |
| 3,430,177 | 2/1969 | Audette | 337/380 |
| 3,601,741 | 8/1971 | Holden | 337/368 |
| 3,636,622 | 1/1972 | Schmitt | 29/622 |
| 3,972,016 | 7/1976 | Schmitt | 337/365 |

*Primary Examiner*—Harold Broome
*Attorney, Agent, or Firm*—John A. Haug; James P. McAndrews

[57] ABSTRACT

A compact, low cost, snap-acting thermostatic switch which can be automatically assembled comprising a single member housing, an unrestrained snap-acting disc, a stationary contact means and a movable contact means with a transfer means attached thereto in which calibration in assembled form can be performed as a single final operation.

9 Claims, 5 Drawing Figures

THERMOSTATIC SWITCH AND METHOD OF ASSEMBLY

BACKGROUND AND SUMMARY OF INVENTION

This invention relates to thermostatic electrical switches and more particularly to low cost, compact, snap-acting thermostatic switches and their method of assembly.

The manufacturing of thermostatic switches employing transfer pins or the like has heretofore been beset with difficulties in producing a compact, low cost, reliable switch. A main reason for the difficulties is the fact it is of the utmost importance that calibration of these switches be precise and reliable. Typically the travel of a snap-acting disc in these thermostats is in the order of 0.010 of an inch. This relatively small travel movement of the disc coupled with the variations in sizes of transfer pins and other components has necessitated complex designs and assembly procedures to insure proper calibration.

Accordingly, it is an object of this invention to provide an improved, compact, low cost thermostatic switch.

It is another object of this invention to provide a thermostatic switch which can be automatically assembled and calibrated.

It is still another object of this invention to provide a thermostatic switch in which calibration, in at least one of the embodiments, can be effected externally of the switch after assembly of the parts therein as a final operation.

It is a further object of this invention to provide an improved method of assembling and calibrating the thermostatic switch. Other objects will be in part apparent and in part pointed out hereinafter.

Briefly, the switch made according to the present invention comprises a single housing member, a contact terminal, a movable arm terminal, two rivets, two electrical contacts, a movable contact arm with a transfer pin attached thereto and a snap-acting bimetallic strip disc. The housing member has a central aperture therethrough with a larger opening at the top of the housing than at the bottom forming a shoulder near the bottom of the housing. On either side of the central aperture is a recessed circular aperture for receiving one of the rivets. One of the electrical contacts is attached to the contact terminal and the other is attached at the distal end of the movable contact arm.

The bimetallic strip disc member is inserted through the top central aperture to rest unrestrained on the shoulder near the bottom of the housing. Then the contact terminal with the contact attached is secured in place by one of the rivets. Next the movable arm terminal and movable contact arm with contact and transfer pin attached are secured to the housing with the other rivet over the central aperture. The rivets secure the two contacting means so that the two electrical contacts, one on the contact terminal and the other on the movable contact arm are initially in engagement with each other. The device is fully assembled and ready for calibration.

The calibration is done with the help of a strain gauge fixture. The fixture is set for the type and shape of the bimetallic disc used and positioned so as to be in contact with the disc to accurately read out contact forces so proper calibration can be performed. All the calibration adjustments are done from the top in assembled form. To help provide for easy calibration the movable contact arm has two right angle bends at the distal end between the transfer pin and electrical contact. The two right angle bends make the movable arm more rigid so there is no lost motion between the pin and the contacts. With this switch the size can be kept small and the construction inexpensive and the various components need only be of approximately correct size.

BRIEF DESCRIPTION OF THE DRAWINGS

Corresponding reference characters indicate corresponding parts throughout the several views of the drawings.

Referring now to FIGS. 1–3 thermostatic switch 10 has a single member housing 12 preferably made from an electrically insulating, heat resistant material such as phenolic resin. Housing 12 has two upstanding side walls 14 extending up from assembly areas 16 of the housing. These walls 14 help protect the parts of the switch. Also a central generally rectangular shaped aperture 18 is provided for in the housing. The size of the aperture 18 decreases at the end near the bottom of housing 10 providing an aperture portion 18.1 of relatively smaller size forming a shoulder 20 facing the opposite top end of the aperture in the housing. Preferably shoulder 20 has a relatively narrow surface portion as shown by FIGS. 2 and 3. Adjacent central aperture 18 are two circular apertures 22 and 24 one on each side for receiving rivet members 26 and 28 to be discussed in more detail below. Apertures 22 and 24 are recessed from the bottom so to provide a minimum acceptable distance from housing bottom to current carrying members.

Figure 2:
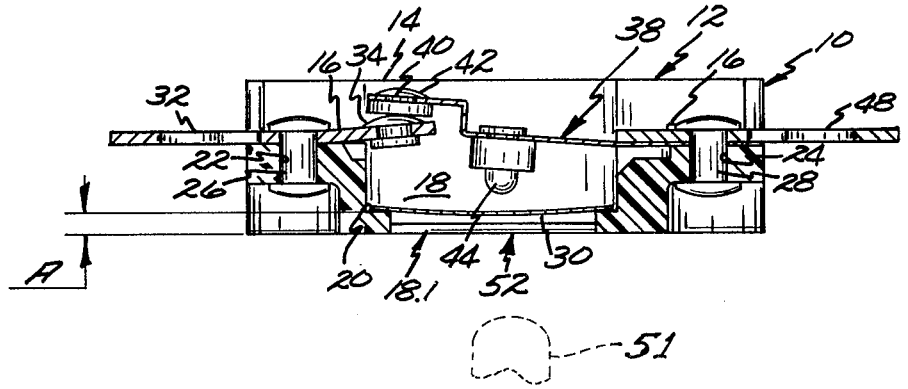
FIG. 2 is a section view along line 2—2 of FIG. 1 with contacts in the closed position.
Figure 3:
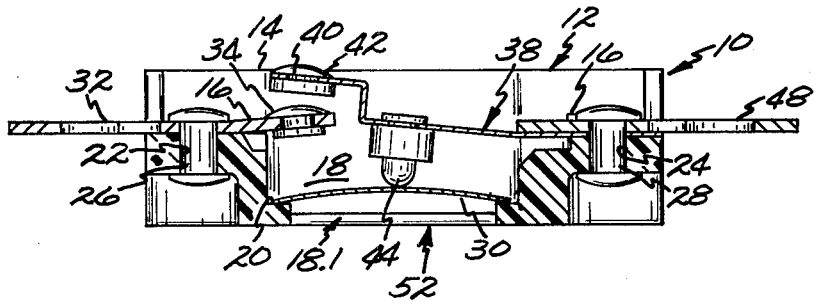
FIG. 3 is similar to FIG. 2 with the contacts in the open position.

A snap-acting bimetallic disc member 30 preferably of the strip type to provide greater snap travel is positioned in aperture 18 of housing 10 to rest on shoulder 20. Preferably the size of aperture 18 is such that the side walls of aperture help locate and center the disc on the shoulder while still providing clearance for easy insertion of the disc in the aperture. The member 30 is responsive to temperature change and will snap over center from a first convex position as shown in FIG. 2 to a second concave shape as shown by FIG. 3 at a first predetermined temperature and back again at a second predetermined temperature. The member is preferably unrestrained other than resting on shoulder 20 to provide reliable, consistent operation.

Figure 1:
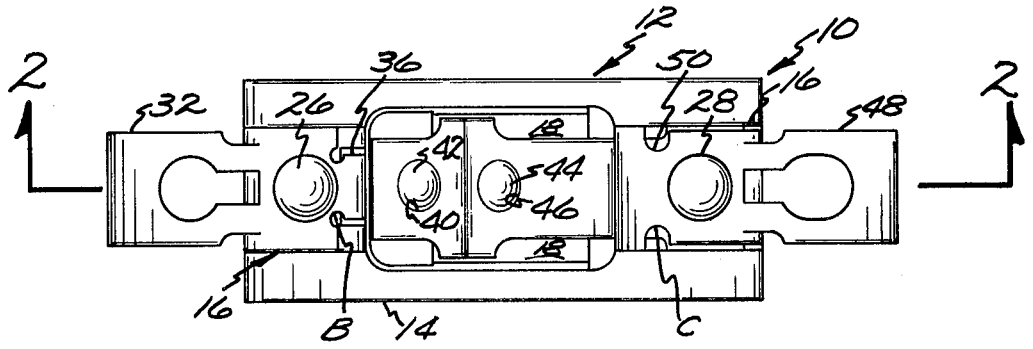
FIG. 1 is a top plan view of the thermostatic switch of this invention.

Accordingly a rivet member 26 or a similar fastening member secures an adjustable contact terminal 32 to housing 10. The rivet and terminal are preferably made from an electrically conductive material such as brass. Typically terminal 32 has two holes in it; one for receiving rivet member 26 and the other for receiving an electrical contact 34 secured at one end of the terminal. Electrical contact 34 may be of the rivet type preferably made from silver or a similar electrical contact material. As best shown in FIG. 1 there is preferably a notched out portion 36 on each side of the terminal to provide a preferential low force bending position on the terminal for calibration. Terminal 32 preferably extends partially over aperture 18 to allow the calibration bending. Additionally tab members (not shown) may be provided which bend over housing 10 to more securely anchor the terminal to the housing.

Figure 4:
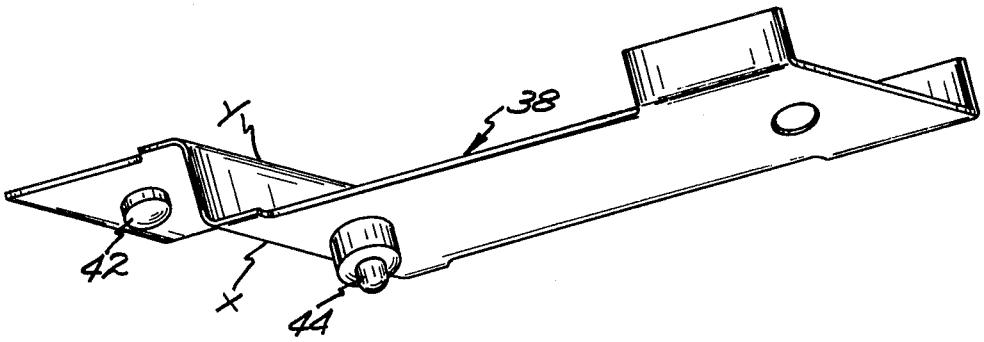
FIG. 4 is a perspective view of a movable contact arm of FIGS. 1–3.

In accordance with this invention, a resilient electrically conductive complementary movable contact arm 38 is used as best shown in FIG. 4. Arm 38 may be made from beryllium copper or other suitable current carrying material. Movable arm 38 has two right angle bends at points X and Y as shown in FIG. 4 adjacent the distal end to provide rigidity to the arm and to provide compact design with minimal lost motion which will be discussed in full detail below. To also improve rigidity the width of the arm is increased in the area of the two right angle bends. At the distal end of arm 38 after the two right angle bends, is preferably a hole 40 for receiving an electrical contact 42 similar to the above-mentioned contact 34. Contact 42 is typically peened over to secure it to the arm. Also a transfer pin 44 is preferably secured through a hole 46 in arm 38 adjacent the two right angle bends but on the opposite side from electrical contact 42 between the right angle bends and the attachment point of the arm to the device. This positioning of pin 44 relative to contact 42 with the right angle bends allows the arm when fastened to the housing to provide virtually one to one movement between the pin and contact. Transfer pin 44 is preferably made from an electrically insulating material such as glass-filled polysulfone and heat staked or the like to the arm.

Rivet member 28 or other similar fastening member secures movable arm 38 and a rigid movable arm terminal 48 to housing 10. The movable arm is preferably cantilever mounted to the housing. Rivet 28 and terminal 48 are preferably made from electrically conductive material such as brass. Preferably movable arm 38 and terminal 48 are welded together to insure reliable electrical connection between the two members. The movable arm 38 extends over aperture 18 and is positioned in relation to terminal 32 so electrical contact 42 is movable into and out of engagement with electrical contact 34. Also transfer pin 44 is positioned on arm 38 within the aperture 18 to rest directly above the center of snap-acting disc member 30 for retaining the disc in the aperture and for transferring movement from the disc to the movable contact arm. This allows switch 10 to be insensitive to position. In a manner similar to terminal 32, terminal 48 also has a notched portion 50 on each side of the terminal to provide for easier calibration, extends partially over aperture 18 to allow the calibration bending and has tab members to more securely anchor the terminal.

Accordingly device 10 is assembled and ready for calibration. The device can be accurately calibrated with dimension A as shown in FIG. 2 which is the distance from the bottom of housing 10 to shoulder 20 and the disc characteristics data. The calibration can be done automatically with the use of a strain gauge fixture as diagrammatically noted at 51 and by arrow 52 in FIG. 2 even when transfer pin size variation occur. There is no need for threaded stops, for sorting pins, or for the use of two part threaded housing assemblies.

In this regard with the disc characteristics data and dimension A taken into account, the strain gauge fixture is set to contact disc member 30 from the bottom through aperture portion 18.1 and to position the disc at an equivalent height from the bottom of the housing as the disc would occupy during snap-action while resting on the shoulder. Typically this height will be in the middle of the snap range of the disc so that opening and closing of the contacts will occur during a snap action. In other words, the height is chosen such that the contacts will not be opened or closed by creep action of the disc prior to snap-action. The assembly of device 10 is set so that the bottom of transfer pin 44 still is not in contact with disc member when the disc is at this height in the middle of the disc snap range. Next terminal 32 is bent downward as viewed in FIG. 2 by applying force at point B of FIG. 1. As will be understood this force is not transmitted to the disc and not reflected on the strain gauge until the pin contacts the disc. Terminal 32 is continued to be bent down, even after the pin contacts the disc until the two electrical contacts break engagement with one another. At this point the force of the pin against the disc is read off the strain gauge and if in the acceptable range the device is properly calibrated. That is, the contacting force between the contacts as read off the strain gauge is acceptable. If this force is too low as is often the case due to the setting of assembly parameters, a force is applied to terminal 48 at point C as shown in FIG. 1 until an acceptable force is obtained thus yielding a properly calibrated switch.

Accordingly a low cost, compact switch which can be automatically calibrated has been described. The single member housing provides for low cost and easy assembly while still maintaining a minimum distance from housing bottom to current carrying members. The bimetallic disc member is unrestrained except for resting on shoulder 20 and in operation does not come into contact with the transfer pin until it has snapped over center thereby providing for reliable, consistent operation. The movable arm has two right angle bends adjacent its distal end to provide a compact design and rigidity and most important minimal lost motion due to flexing of the arm between the transfer pin and the contact. Also the calibration can be carried out with the switch in assembled form. It is designed so that variations in tranfer pins or other components do not effect accurate calibration and all adjustments can be done from the top.

Figure 5:
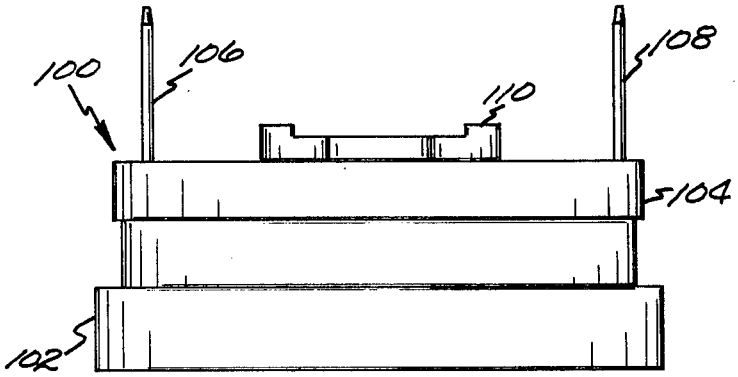
FIG. 5 is a front view of a second embodiment of the thermostatic switch of this invention.

Referring now to FIG. 5, a second embodiment of the present invention is shown. A switch 100 similar to switch 10 has a wider housing 102 and top cover 104. The cover serves to protect the components of the switch. The internal components of switch 100 are identical to those of switch 10 except two terminals 106 and 108 of switch 100 are bent upward rather than lying in a horizontal plane. It is to be understood the terminals may be positioned in any convenient location. A U-shaped member 110 on cover 104 may also be provided to receive a clamping means to hold and position switch 100 within an appliance or the like. The calibration of switch 100 is identical to that of switch 10 except after calibration top cover 104 must be added.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawing shall be interpreted as illustrative and not in a limiting sense.

I claim:

1. A method of assembling a thermostatic switch comprising:

providing a housing having an aperture which extends through the housing and which has an aperture portion of relatively smaller size adjacent one end of the aperture forming a shoulder facing toward the opposite end of the aperture;

inserting a thermostatic, snap-acting, bimetallic disc within said aperture to rest freely on said shoulder to be accessible through said smaller aperture portion;

mounting a stationary contact means on said housing;

attaching an electrically insulating transfer means to a movable complementary contact means;

mounting said movable complementary contact means with said transfer means attached thereto in said housing extending over said aperture to be movable into and out of engagement with said stationary contact means and to position said transfer means within said aperture for retaining said disc in said aperture and for transferring movement from said snap-acting disc to said movable contact means in response to disc movement due to temperature change, making two right angle bends in said movable contact means to provide minimal lost motion during said transfer movement for more reliable calibration;

engaging said bimetallic disc through the aperture of smaller size with a strain gauge for lifting said disc off said shoulder with the strain gauge;

positioning the disc with the strain gauge at an equivalent height as the disc would occupy during snap-action while resting on said shoulder;

bending said stationary contact means toward said disc until said stationary contact means and said complementary contact means break engagement and said transfer means exerts a force on said disc;

reading said transfer means force on the disc off the strain gauge and determining if an acceptable range is achieved for proper calibration; and bending said movable complementary contact means to provide an acceptable force range if an acceptable force was not achieved by bending said stationary contact means alone.

2. A method of calibrating a thermostatic switch having a housing with an aperture which extends through the housing and which has an aperture portion of relatively smaller size adjacent one end of the aperture forming a shoulder facing the opposite end of the aperture, having a thermostatic snap-acting bimetallic disc member disposed within said aperture against said shoulder to be accessible through said smaller aperture portion, having a stationary contact means mounted on said housing, having a movable complementary contact means mounted in said housing extending over said aperture to be movable into and out of engagement with said stationary contact means and having an electrically insulating transfer means attached to said movable contact means disposed within said aperture between said disc and movable contact means for retaining said disc in said aperture and for transferring movement from said snap-acting disc to said movable contact means in response to disc movement due to temperature change comprising:

engaging said bimetallic disc through the aperture of smaller size with a strain gauge for lifting said disc off said shoulder with the strain gauge;

positioning the disc with the strain gauge at an equivalent height as the disc would occupy during snap-action while resting on said shoulder;

bending said stationary contact means toward said disc until said stationary contact means and said complementary contact means break engagement and said transfer means exerts a force on said disc;

reading said transfer means force on the disc off the strain gauging and determining if an acceptable range is achieved for proper calibration; and bending said movable complementary contact means to provide an acceptable force range if an acceptable force was not achieved by bending said stationary contact means alone.

3. A method of calibrating a thermostatic switch as set forth in claim 2 wherein said equivalent height as the disc would occupy would be in the middle of the snap-action range.

4. A method of calibrating a thermostatic switch having a housing with a disc seating shoulder, the housing having an aperture which extends into the housing, having a thermostatic snap-acting bimetallic disc member disposed within said housing against said shoulder, having a stationary contact means mounted on said housing, having a movable complementary contact means mounted in said housing to be movable into and out of engagement with said stationary contact means and having an electrically insulating transfer means disposed within said housing between said disc and movable contact means for retaining said disc at its seating shoulder and for transferring movement from said snap-acting disc to said movable contact means in response to disc movement due to temperature change comprising:

engaging said bimetallic disc through the aperture with a strain gauge for lifting said disc off said shoulder with the strain gauge;

positioning the disc with the strain gauge at an equivalent height as the disc would occupy during snap-acting while resting on said shoulder;

bending said stationary contact means toward said disc until said stationary contact means and said complementary contact means break engagement and said transfer means exerts a force on said disc;

reading said transfer means force on the disc off the strain gauging and determining if an acceptable range is achieved for proper calibration; and bending said movable complementary contact means to provide an acceptable force range if an acceptable force was not achieved by bending said stationary contact means alone.

5. A method of calibrating a thermostatic switch as set forth in claim 4 wherein said equivalent height as the disc would occupy would be in the middle of the snap-action range.

6. A thermostatic switch comprising a base member, an aperture defined by a side wall extending through the base from a first side to an opposed second side, a disc seating shoulder formed in the side wall, a thermostatic bimetallic disc having an outer peripheral margin disposed in the aperture with the outer peripheral margin supported on the disc seating shoulder, a first terminal element supported on the first side of the base extending over the aperture, a second terminal element supported on the first side of the base, a movable contact arm having a first end captured between the second terminal element and the base, the arm extending and terminating over the aperture in a free distal end adapted to move into and out of electrical engagement with a portion of the first terminal extending over the aperture; a motion transfer member disposed within the aperture between the movable contact arm and the disc to transfer motion from the disc to the movable contact arm and to prevent dislocation of the disc from the disc seating shoulder, the movable contact arm having an extended width section over a portion of its length intermediate the first end and the free distal end, the movable contact arm having two approximately right angle bends in the extended width section so that the free distal end of the movable arm lies in a plane spaced from and generally parallel to the remainder of the movable contact arm.

7. A thermostatic switch according to claim 6 in which the motion transfer member is attached to the movable contact arm intermediate the first end thereof and the right angle bends.

8. A thermostatic switch according to claim 7 in which the motion transfer member is attached to the movable contact arm adjacent the extended width section.

9. A thermostatic switch according to claim 6 in which the thermostatic bimetallic disc is a strip type, snap acting disc.

* * * * *